US011459697B2

(12) United States Patent
Lee et al.

(10) Patent No.: US 11,459,697 B2
(45) Date of Patent: Oct. 4, 2022

(54) CLOTHES CARE APPARATUS

(71) Applicant: SAMSUNG ELECTRONICS CO., LTD., Suwon-si (KR)

(72) Inventors: Geon Ung Lee, Suwon-si (KR); Hyun Joo Kim, Suwon-si (KR); Eung Ryeol Seo, Suwon-si (KR); Dong Woo Shin, Suwon-si (KR); Seung-Mok Lee, Suwon-si (KR); Hwang Mook Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 70 days.

(21) Appl. No.: 17/269,664

(22) PCT Filed: Jun. 28, 2019

(86) PCT No.: PCT/KR2019/007887
§ 371 (c)(1),
(2) Date: Feb. 19, 2021

(87) PCT Pub. No.: WO2020/040420
PCT Pub. Date: Feb. 27, 2020

(65) Prior Publication Data

US 2021/0310180 A1 Oct. 7, 2021

(30) Foreign Application Priority Data

Aug. 20, 2018 (KR) ..... 10-2018-0096979

(51) Int. Cl.
*D06F 58/10* (2006.01)
*D06F 58/20* (2006.01)
*D06F 73/02* (2006.01)

(52) U.S. Cl.
CPC ..... *D06F 58/10* (2013.01); *D06F 58/206* (2013.01); *D06F 73/02* (2013.01)

(58) Field of Classification Search
CPC ..... D06F 58/206; D06F 58/10; D06F 73/02
See application file for complete search history.

(56) References Cited

U.S. PATENT DOCUMENTS 5,516,012 A * 5/1996 Weigel ..... D06F 73/02 223/51
6,189,346 B1 * 2/2001 Chen ..... D06F 73/02 68/5 R (Continued)

FOREIGN PATENT DOCUMENTS

JP 2001-70696 3/2001
JP 2017-86136 5/2017

(Continued)

OTHER PUBLICATIONS

International Search Report dated Oct. 25, 2019 from International Application No. PCT/KR2019/007887, 5 pages.

*Primary Examiner* — Benjamin L Osterhout
(74) *Attorney, Agent, or Firm* — Staas & Halsey LLP

(57) ABSTRACT

A clothes care apparatus comprises a main body including a clothes care compartment, a clothes support member disposed in the clothes care compartment and including an air supply port provided to allow air to flow therein, a blower configured to form an airflow to be supplied to the clothes support member, and a nozzle provided to guide the airflow formed by the blower to the clothes support member, and including an airflow outlet disposed to face the air supply port, the airflow outlet provided to supply an airflow to an inside and an outside of the clothes support member.

15 Claims, 11 Drawing Sheets

(56) References Cited

U.S. PATENT DOCUMENTS

| | | | | |
|---|---|---|---|---|
| 2012/0017654 | A1* | 1/2012 | Park | D06F 73/02 68/5 C |
| 2012/0240425 | A1* | 9/2012 | Park | D06F 58/203 68/6 |
| 2012/0317729 | A1* | 12/2012 | Song | D06F 58/10 68/6 |

FOREIGN PATENT DOCUMENTS

| | | |
|---|---|---|
| KR | 10-2014-0003984 | 1/2014 |
| KR | 10-1608655 | 4/2016 |
| KR | 10-2018-0037459 | 4/2018 |
| KR | 10-1867505 | 6/2018 |

* cited by examiner

CLOTHES CARE APPARATUS

CROSS-REFERENCE TO RELATED APPLICATIONS

This application is a U.S. National Stage Application, which claims the benefit under 35 U.S.C. § 371 of PCT International Patent Application No. PCT/KR2019/007887, filed Jun. 28, 2019 which claims the foreign priority benefit under 35 U.S.C. § 119 of Korean Patent Application No. 10-2018-0096979, filed Aug. 20, 2018, the contents of which are incorporated herein by reference.

TECHNICAL FIELD

The present disclosure relates to a clothes care apparatus, more particularly to a clothes care apparatus capable of performing clothes care using an airflow.

BACKGROUND ART

In general, a clothes care apparatus refers to a device that performs washing or drying laundry. Among the clothes care apparatuses, a clothes care apparatus having a drying function is provided with a hot air supply device that supplies hot air to an accommodation space where clothes are accommodated for drying, and a steam generator configured to perform a refresh function such as wrinkle reduction, deodorization, and static removal on an object such as clothes.

The clothes care apparatus is provided with a cabinet in which a storage compartment for storing clothes is formed. The storage compartment for storing clothes is formed in an upper portion of the cabinet and an electronics compartment, in which a steam generator or a hot air supply device is placed, is formed under the storage compartment. The storage compartment and the electronics compartment may be separated by a partition wall.

The clothes care apparatus may include a clothes support member provided in the storage compartment for hanging the clothes. The clothes care apparatus may perform clothes care by translational and/or rotational movement of the clothes support member, or perform the clothes care by providing an airflow to the clothes support member.

DISCLOSURE

Technical Problem

The present disclosure is directed to providing a clothes care apparatus capable of providing an airflow to an inside and an outside of clothes.

Further, the present disclosure is directed to providing a clothes care apparatus capable of appropriately distributing and providing an airflow to a plurality of clothes support members.

Further, the present disclosure is directed to providing a clothes care apparatus capable of reducing loss of airflow supplied to a clothes support member.

Technical Solution

One aspect of the present disclosure provides a clothes care apparatus including a main body including a clothes care compartment, a clothes support member disposed in the clothes care compartment and including an air supply port provided to allow air to flow therein, a blower configured to form an airflow to be supplied to the clothes support member, and a nozzle provided to guide the airflow formed by the blower to the clothes support member, and including an airflow outlet disposed to face the air supply port, the airflow outlet provided to supply an airflow to an inside and an outside of the clothes support member. A size of the airflow outlet is greater than a size of the air supply port.

The main body may include an airflow inlet formed on a rear surface of the main body, and the blower may be configured to suction air, which is discharged to the clothes support member though the airflow outlet, through the airflow inlet and configured to discharge the suctioned air to the airflow outlet.

A size of the airflow outlet may be greater than a size of the air supply port.

The nozzle may include a blade provided to guide and distribute the airflow, which is supplied from the blower, to the clothes support member.

The blade may include a curved portion provided to change a direction of the airflow supplied from the blower.

The blade may be formed to face the outside of the clothes support member along a direction in which air moves.

The clothes care apparatus may further include a top cover provided to connect the blower to the nozzle and provided to form a guide flow path, and the top cover may include a central portion and a vortex reducing portion formed to be recessed on opposite sides of the central portion.

The vortex reducing portion may be provided to guide a portion of the air, which is discharged from the blower, to the central portion.

The top cover may include a blade provided to guide the air, which is discharged from the blower, to the nozzle.

The vortex reducing portion may be formed to be inclined downwardly along a direction in which the air, which is discharged from the blower, moves.

The blower may include two blower fans, and the nozzle may include a center nozzle, and two side nozzles arranged on opposite sides of the center nozzle. The side nozzle may include a guide rib arranged on one side thereof facing the blower fan.

The guide rib may be provided to change a moving direction of a portion of the airflow supplied from the blower.

The guide rib may be provided to guide a portion of the air, which is discharged from the blower, toward the center nozzle.

The clothes support member may include a guide protrusion provided to guide a portion of the air, which is discharged from the airflow outlet, toward the outside of the clothes support member.

The nozzle may include a discharge rib provided to guide a portion of the air, which is discharged from the airflow outlet, toward the outside of the clothes support member.

A direction of the airflow, which is supplied to the clothes support member through the nozzle, may be different from a direction of the airflow formed by the blower.

Another aspect of the present disclosure provides a clothes care apparatus including a main body including a clothes care compartment, a clothes support member disposed in the clothes care compartment and including an air supply port provided to allow air to flow therein, a blower configured to form an airflow to be supplied to the clothes support member, a nozzle provided to supply the airflow, which is formed in the blower, to the clothes support member with a direction different from a direction in which the airflow is discharged from the blower, and including an airflow outlet disposed to face the air supply port, and a top cover provided to connect the blower to the nozzle and including a vortex reducing portion formed such that a portion thereof is recessed. A size of the air supply port is less than a size of the airflow outlet.

The nozzle may include a blade provided to distribute and supply air, which is supplied to the top cover, to the clothes support member.

The clothes support member may include a guide protrusion provided to protrude from an outer surface thereof adjacent to the air supply port.

The nozzle may include a discharge rib provided to extend from the airflow outlet to an outside.

Another aspect of the present disclosure provides a clothes care apparatus including a main body including a clothes care compartment, a clothes support member disposed in the clothes care compartment and including an air supply port provided to allow air to flow therein, a blower configured to form an airflow to be supplied to the clothes support member, and a nozzle provided to supply the airflow, which is formed in the blower, to the clothes support member and including an airflow outlet disposed to face the air supply port. A size of the air supply port is less than a size of the airflow outlet. The clothes support member includes a guide protrusion provided to guide a portion of the air, which is discharged from the airflow outlet, toward the outside of the clothes support member.

Advantageous Effects

A clothes care apparatus may provide an airflow to not only an inside of clothes but also an outside of the clothes because a second airflow outlet is formed to be larger than an air supply port of a clothing support member.

A clothes care apparatus may appropriately distribute and supply an airflow to a plurality of clothes support members because the clothes care apparatus includes a configuration configured to guide the airflow discharged from a second blower fan.

A clothes care apparatus may reduce loss of airflow supplied to a clothes support member because a top cover provided to guide an airflow discharged from a second blower fan includes a vortex reducing portion.

MODES OF THE INVENTION

Figure 1:
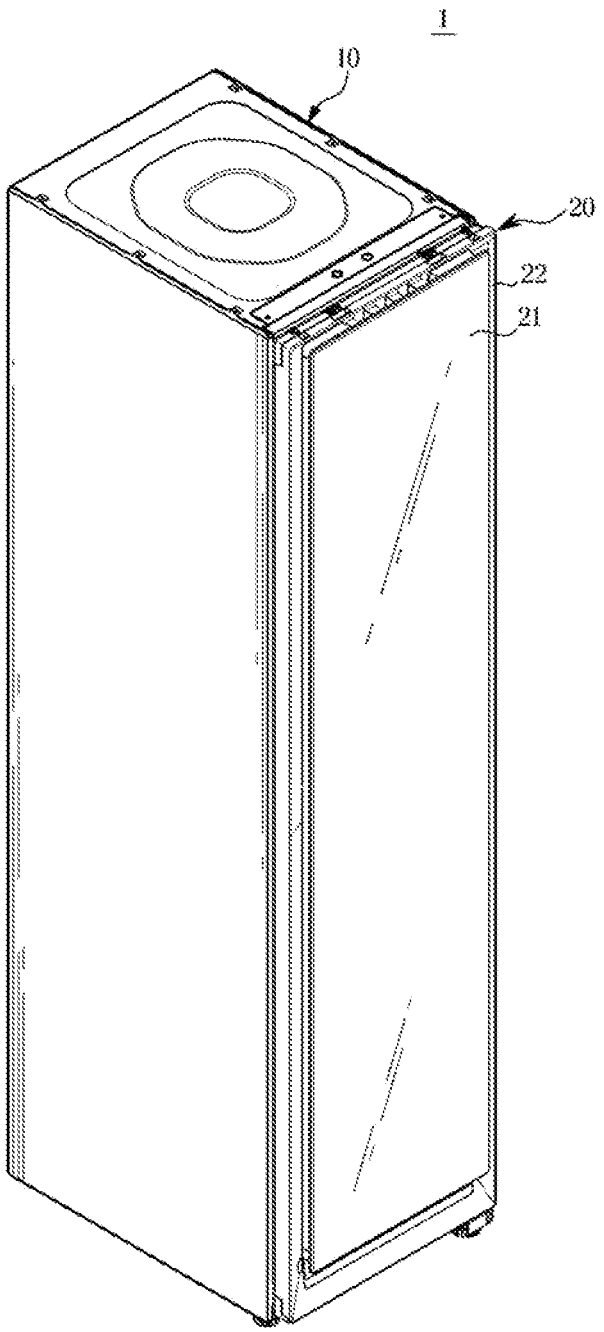
FIG. 1 is a view of a clothes care apparatus according to one embodiment of the present disclosure.

Embodiments described in the disclosure and configurations shown in the drawings are merely examples of the embodiments of the disclosure, and may be modified in various different ways at the time of filing of the present application to replace the embodiments and drawings of the disclosure.

Parts which are not associated with the description are omitted in order to particularly describe the disclosure, and like reference numerals refer to like elements throughout the specification.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front side", "rear side", "left side", "right side", and the like may be defined by the drawings, but the shape and the location of the component is not limited by the term.

Hereinafter exemplary embodiments of the present disclosure will be described in detail with reference to the accompanying drawings.

Figure 2:
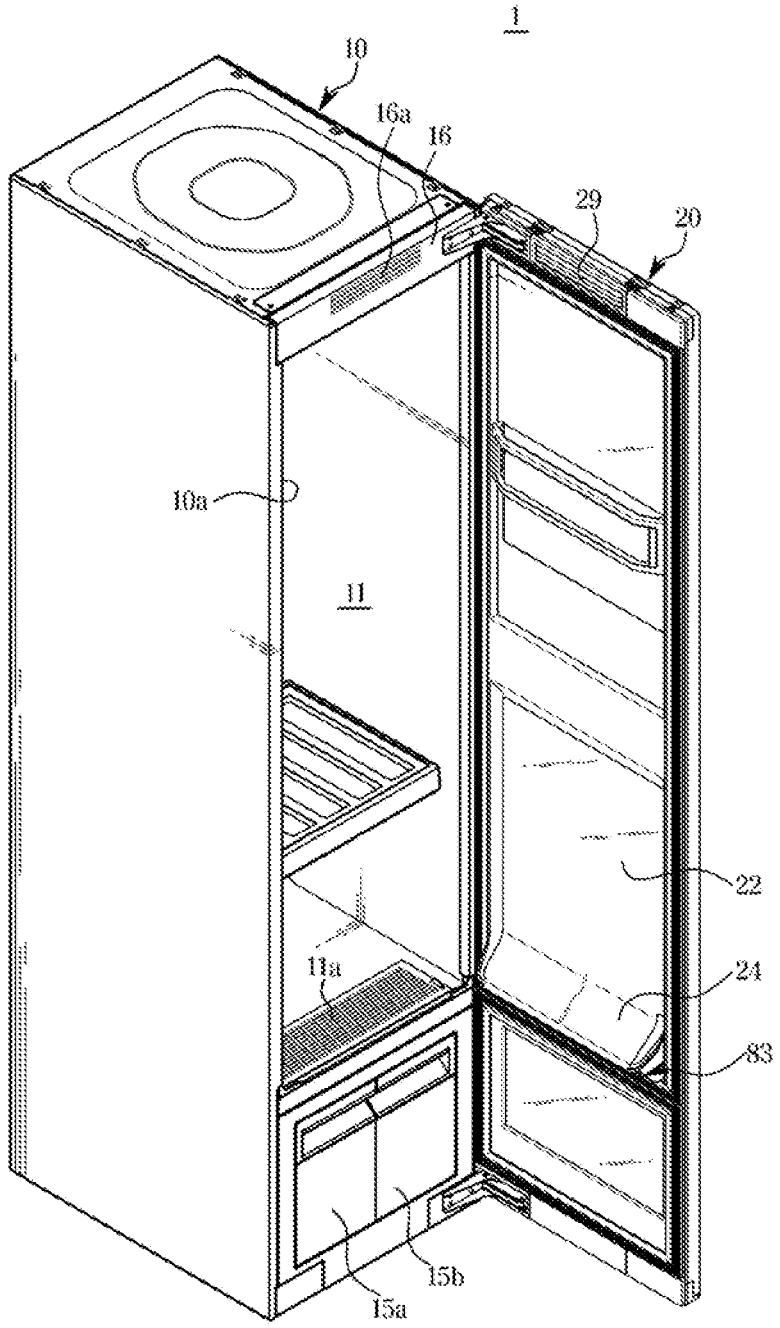
FIG. 2 is a view illustrating a state in which a door of the clothes care apparatus shown in FIG. 1 is opened.
Figure 3:
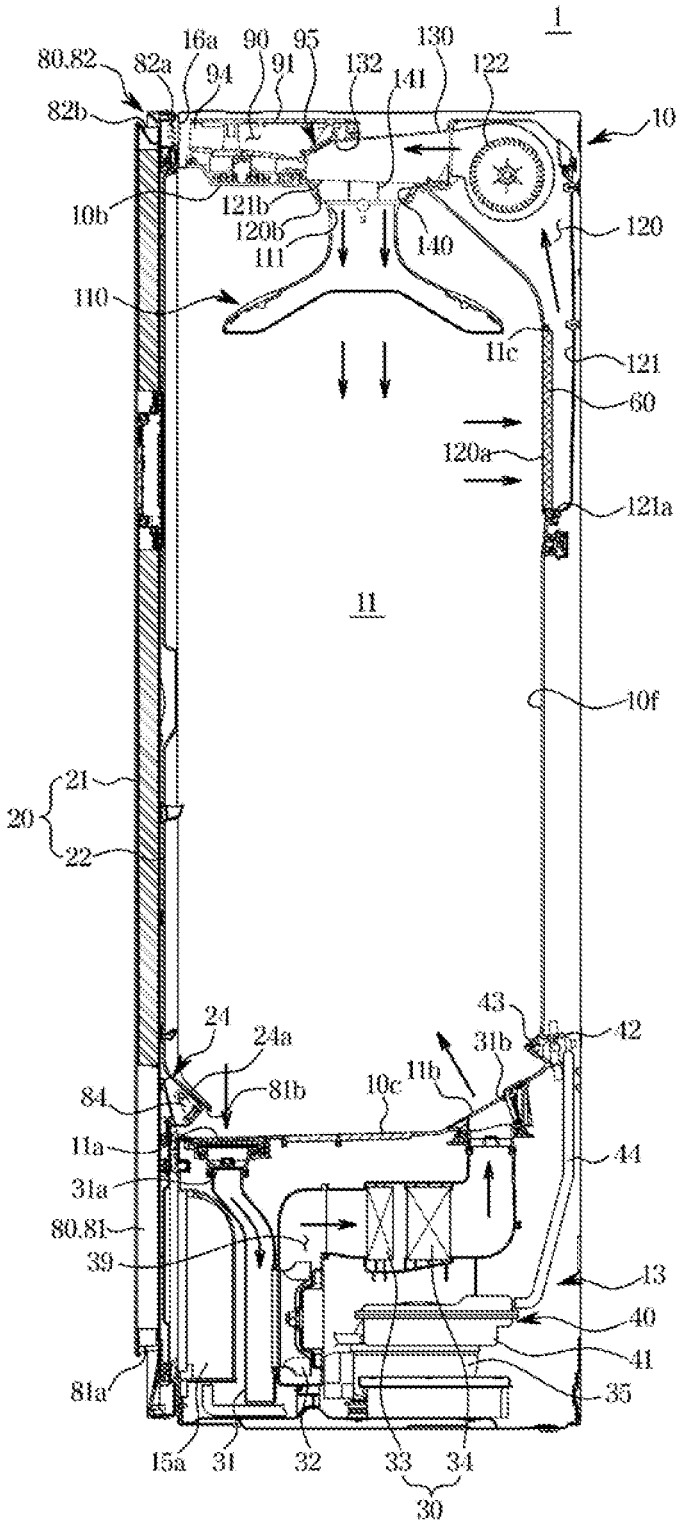
FIG. 3 is a side cross-sectional view of the clothes care apparatus shown in FIG. 1.
Figure 4:
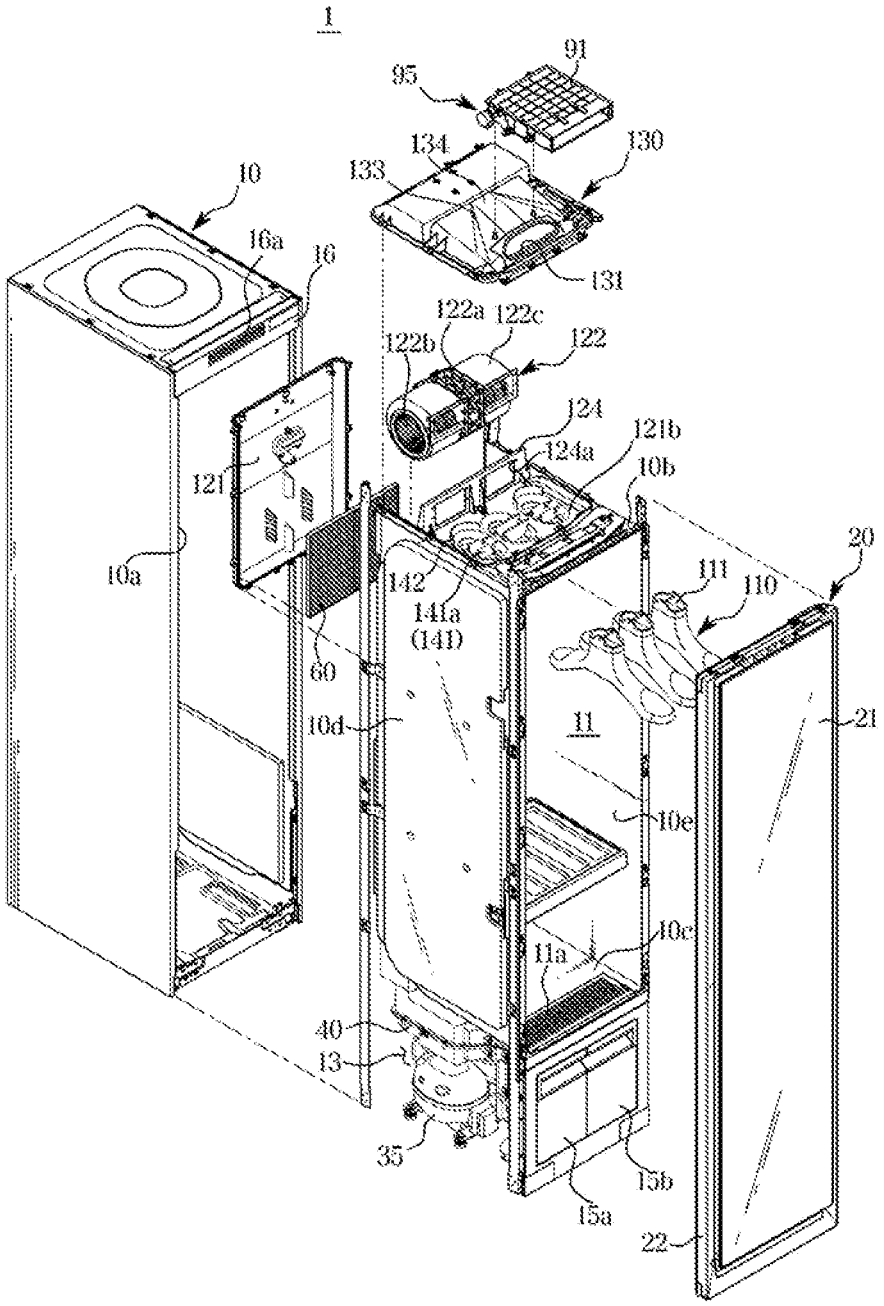
FIG. 4 is an exploded view illustrating the clothes care apparatus shown in FIG. 1.

FIG. 1 is a view of a clothes care apparatus according to one embodiment of the present disclosure. FIG. 2 is a view illustrating a state in which a door of the clothes care apparatus shown in FIG. 1 is opened. FIG. 3 is a side cross-sectional view of the clothes care apparatus shown in FIG. 1. FIG. 4 is an exploded view illustrating the clothes care apparatus shown in FIG. 1.

Referring to FIGS. 1 to 4, a clothes care apparatus 1 may include a main body 10 provided to form an exterior thereof, a door 20 rotatably coupled to the main body 10, a clothes care compartment 11 provided inside the main body 10 and in which clothes is placed and clothes care is performed on the clothes, a clothes support member 110 provided inside the clothes care compartment 11 and configured to allow clothes to be hung thereon, and a machine room 13 provided with a heat exchanger 30 configured to dehumidify or heat air inside the clothes care compartment 11.

The clothes care compartment 11 may be formed in the main body 10, and the clothes care compartment 11 may have a hexahedron shape having an open surface. An opening 10*a* may be formed on a front surface of the main body 10. The door 20 configured to be rotatable to open and close the clothes care compartment 11 may be installed in the opening 10*a* of the main body 10. Although not shown, the door 20 may be installed through a connecting member such as a hinge and a link.

The clothes care compartment 11 forms a space in which clothes are accommodated. The clothes care compartment 11 may include an upper surface 10*b*, a lower surface 10*c*, a left side surface 10*d*, a right side surface 10*e*, and a rear surface 10*f* provided in the inside of the main body 10. An opening is formed on a front surface of the clothes care compartment 11. Therefore, the opening of the clothes care compartment 11 may also be opened and closed by the door 20 configured to open and close the opening 10*a* of the main body 10.

A discharge bracket 16 installed at a position corresponding to a discharge flow path 29 of the door 20 to be described later may be provided at an upper end of the opening 10*a* of the main body 10. The discharge bracket 16 may include a plurality of discharge slits 16*a* disposed to correspond to the discharge flow path 29 of the door 20.

The clothes care compartment 11 may include a first airflow inlet 11*a*, a second airflow inlet 120*a*, a first airflow outlet 11*b*, a second airflow outlet 120*b*, and a steam outlet 43. The first airflow inlet 11*a* and the first airflow outlet 11*b* may be formed on the lower surface 10*c* of the clothes care compartment 11. The first airflow inlet 11*a* may be arranged in a front portion of the lower surface 10*c* of the clothes care compartment 11. The first airflow outlet 11*b* may be arranged in a rear portion of the lower surface 10*c* of the clothes care compartment 11.

The first airflow inlet 11*a* and the first airflow outlet 11*b* may be arranged adjacent to each other.

The steam outlet 43 may be disposed in a lower portion of the rear surface 10*f* of the clothes care compartment 11. The steam outlet 43 may be disposed above the first airflow outlet 11*b*.

The second airflow inlet 120*a* may be formed at an upper portion of the rear surface 10*f* of the clothes care compartment 11. The second air flow outlet 120*b* may be formed at a substantially central portion of the upper surface 10*b* of the clothes care compartment 11. The second airflow inlet 120*a* and the second airflow outlet 120*b* may be arranged adjacent to each other.

In the lower portion of the main body 10, a water drain tank 51*a* and a water supply tank 15*b* which are separable from the main body 10 may be installed. The water drain tank 15*a* and the water supply tank 15*b* may be arranged under the clothes care compartment 11. The water drain tank 15*a* may be configured to easily manage condensed water. The water supply tank 15*b* may store water needed for generating steam for a steam generation device 40. Water stored in the water supply tank 15*b* may be supplied to the steam generation device 40 to generate steam. The water supply tank 15*b* may be removably installed to the main body 10 to easily supplement water.

The water drain tank 15*a* and the water supply tank 15*b* may be provided in front of the machine room 13. The machine room 13 may be under the clothes care compartment 11. The machine room 13 may include the heat exchanger 30 configured to dehumidify and heat air in the clothes care compartment 11 as needed.

A first blower fan 32, the heat exchanger 30, and the steam generation device 40 may be arranged in the machine room 13.

The heat exchanger 30 is installed to supply hot air into the clothes care compartment 11. The heat exchanger 30 includes an evaporator 33, a compressor 35 and a condenser 34 through which a refrigerant circulates, and the heat exchanger 30 is configured to dehumidify and heat the air.

As the refrigerant evaporates in the evaporator 33 of the heat exchanger 30, the refrigerant absorbs latent heat of the ambient air so as to condense and remove moisture in the air. In addition, in response to that the refrigerant is passed through the compressor 35 and then condensed in the condenser 34, the refrigerant releases the latent heat toward the ambient air so as to heat the ambient air. That is, the evaporator 33 and the condenser 34 serve as heat exchangers, and the air, which flows into the machine room 13 by the first blower fan 32, is dehumidified and heated while passing through the evaporator 33 and the condenser 34 sequentially.

The heat exchanger 30 installed in the machine room 13 may include a first duct 31 configured to connect the evaporator 33, the condenser 34 and the first blower fan 32, and thus the first duct 31 may be connected to the clothes care compartment 11 so as to form a first circulation flow path 39 configured to circulate between the clothes care compartment 11 and the first duct 31.

The first duct 31 may be connected to the first airflow inlet 11*a* and the first airflow outlet 11*b* of the clothes care compartment 11. One end of the first duct 31 may be connected to the first airflow inlet 11*a* of the clothes care compartment 11, and the other end of the first duct 31 may be connected to the first airflow outlet 11*b* of the clothes care compartment 11. A first duct inlet 31*a* of the first duct 31 may be connected to the first airflow inlet 11*a* and a first duct outlet 31*b* may be connected to the first airflow outlet 11*b*.

Air in the clothes care compartment 11 may be introduced into the first duct 31 through the first airflow inlet 11*a* and the introduced air may be dehumidified and then discharged to the clothes care compartment 11 through the first airflow outlet 11*b*. According to one embodiment, it is assumed that the first airflow inlet 11*a* is arranged in the front portion of the clothes care compartment 11 and the first airflow outlet 11*b* is arranged in the rear portion of the clothes care compartment 11, but is not limited thereto. Therefore, a location of the airflow inlet and the airflow outlet may vary, as needed.

The first duct 31 is provided to dehumidify the air flowing through the first airflow inlet 11*a*, and to discharge the dehumidified air to the first airflow outlet 11*b*. The first blower fan 32 is installed on the first duct 31 to suction the air of the clothes care compartment 11 into the first duct 31.

The machine room 13 may further include the steam generation device 40 configured to generate steam by receiving water from the water supply tank 15*b*. The steam generation device 40 may include a steam generator 41 connected to the water supply tank 15*b* to receive the water so as to generate steam, and a steam supply pipe 44 configured to guide the generated steam to a steam injector 42. The steam injector 42 may be arranged in a lower portion of the rear surface of the clothes care compartment 11.

A heater (not shown) may be installed inside the steam generator 41 so as to heat water.

The clothes care apparatus 1 may include a dehumidification flow path 80 provided in the door 20 so as to connect the clothes care compartment 11 to the outside during indoor dehumidification is performed. The dehumidification flow path 80 may be provided in the door 20. At least one dehumidification flow path 80 may be provided. The door 20 may include the dehumidification flow path 80 provided to allow the clothes care compartment 11 to communicate with the outside.

The door 20 may include a first door member 21 forming a front surface, and a second door member 22 coupled to the first door member 21 to form a rear surface.

The dehumidification flow path 80 may be formed between the first door member 21 and the second door member 22. At least one of the dehumidification flow path 80 may be formed between the first door member 21 and the second door member 22. The dehumidification flow path 80 may be formed in at least one of the first door member 21 and the second door member 22.

The dehumidification flow path 80 may include an inlet flow path 81 configured to suck outside air to the inside of the clothes care compartment 11 and an outlet flow path 82 configured to discharge the internal air of the clothes care compartment 11 to the outside.

The first door member 21 is formed in a plate shape. The first door member 21 may include a mirror, a glass, or a panel. Although the first door member 21 of the clothes care apparatus 1 of FIG. 1 is illustrated as a plate-shaped mirror, the present disclosure is not limited thereto. Alternatively, the first door member may include a cover formed of various materials that are coupled to have a sense of unity with furniture in the room where the clothes care apparatus 1 is installed.

The first door member 21 may be installed in front of the second door member 22 to form the exterior of the clothes care apparatus 1.

The inlet flow path 81 is provided to allow air, which is introduced through a first inlet 81*a*, to be moved and discharged to the clothes care compartment 11 through a first outlet 81*b*.

The inlet flow path 81 may include an inlet flow path duct 83 provided to guide the air, which is introduced through the first inlet 81*a*, to be moved. The first outlet 81*b* may be formed in the inlet flow path duct 83.

The inlet flow path 81 may include a first damper 84 configured to open and close the first outlet 81*b*. The first damper 84 may be provided inside the inlet flow path duct 83. The inlet flow path duct 83 includes the first damper 84 configured to open and close the first outlet 81*b*.

The door 20 may include a condensate guide 24 provided to guide a movement of condensed water. The condensate guide 24 may be provided to guide condensed water formed by condensation on the rear surface of the door 20. The condensate guide 24 may include a curved portion 24*a* formed to be inclined downward from the rear surface of the second door 22 toward the clothes care compartment 11.

The curved portion 24*a* of the condensate guide 24 may include at least one surface of the inlet flow path duct 83. The curved portion 24*a* of the condensate guide 24 may form an upper surface of the inlet flow path duct 83.

The outlet flow path 82 may allow air, which is introduced through a second inlet 82*a*, to be moved and discharged to the outside of the clothes care compartment 11 through a second outlet 82*b*. The outlet flow path 82 may be provided in the door 20 so as to discharge the internal air of the clothes care compartment 11 to the outside.

The main body 10 further includes a connection flow path 90 configured to connect a second circulation flow path 120 to the outlet flow path 82 to deliver the internal air of the clothes care compartment 11 to the outlet flow path 82.

The connection flow path 90 may be formed in a top cover 130 provided above the clothes care compartment 11. The connection flow path 90 may be formed in connection with the second circulation flow path 120. The connection flow path 90 may be formed to be branched from the second circulation flow path 120.

The connection flow path 90 may include a connection duct 91. The connection flow path 90 may be formed inside the connection duct 91. The connection duct 91 may be coupled to the top cover 130. The connection flow path 90 may be formed by coupling the connection duct 91 to the top cover 130. For this, the top cover 130 may include a duct coupling portion 135. The top cover 130 may include a connection flow path hole 132. The connection flow path hole 132 may be formed in front of the top cover 130. The connection duct 91 is formed to be connected to the connection flow path hole 132 of the top cover 130.

A connection duct outlet 94 connected to the opening 10*a* of the main body 10 may be formed on the front surface of the connection duct 91. The connection duct outlet 94 may be formed on the front surface of the connection duct 91 to allow that air of the second circulation flow path 120, which is introduced through the connection flow path hole 132, is introduced to the connection flow path 90 and moved toward the opening 10*a* of the main body 10 through the connection duct outlet 94.

A second damper 95 may be provided inside the connection duct 91 to open and close the second circulation flow path 120. The second damper 95 may be configured to open and close the connection flow path hole 132 of the top cover 130.

The connection duct outlet 94 of the connection duct 91 may be formed to correspond to the dehumidification flow path 80 formed in the door 20. The connection duct outlet 94 may be formed to correspond to the outlet flow path 82 of the door 20. The connection duct outlet 94 may be formed at a position corresponding to the second inlet 82*a* of the outlet flow path 82. The connection duct outlet 94 may be arranged to be connected to the second inlet 82*a* of the outlet flow path 82.

The outlet flow path 82 may include the second inlet 82*a* and the second outlet 82*b* formed to discharge air of the clothes care compartment 11, which is introduced through the second inlet 82*a*, to the outside of the main body 10 and the door 20.

The second inlet 82*a* is provided in the second door member 22 of the door 20. The second inlet 82*a* is provided in an upper portion of the second door member 22. The second inlet 82*a* is formed on the rear surface of the second door member 22. The second inlet 82*a* is formed at a position corresponding to the connection duct outlet 94 of the connection duct 91. The air of the second circulation flow path 120 that is the internal air of the clothes care compartment 11, which is introduced through the second inlet 82*a*, is discharged to the second outlet 82*b*. The second outlet 82*b* is provided on an upper portion of the door 20. The second outlet 82*b* is formed on the upper portion of the second door member 22. The second inlet 82*a* communicates with the second outlet 82*b*. Air of the clothes care compartment 11 introduced into the second circulation flow path 120 may be discharged to the outside of the main body 10 through the connection flow path 90 and the door 20 upon dehumidification of the clothes care compartment 11.

The outlet flow path 82 formed between the second inlet 82*a* and the second outlet 82*b* may include an outlet guide 86 provided to guide air to be discharged to the second outlet 82*b*. At least one outlet guide 86 are provided. The outlet guide 86 is formed to guide air, which introduced through the second inlet 82*a*, toward the second outlet 82*b*. The outlet flow path 82 may further include an outlet flow path guide 87 formed in the second door member 22. The outlet flow path guide 87 may be formed on an upper end of the second door member 22. Air, which is introduced to the outlet flow path 82 through the second inlet 82*a*, is guided by the outlet flow path guide 87 and then discharged to the outside of the door 20.

During a dehumidification operation of the clothes care apparatus 1 according to one embodiment of the present disclosure, it is possible to allow the clothes care compartment 11 of the main body 10 to communicate with the room through the dehumidification flow path 80 provided in the door 20.

The clothes support member 110 configured to allow clothes to be hung and to be supported, is provided in the clothes care compartment 11. The clothes support member 110 may be installed on the upper surface 10*b* of the clothes care compartment 11. The clothes support member 110 may be removably installed in the clothes care compartment 11. At least one clothes support member 110 may be provided. The clothes support member 110 may be formed in a hanger shape to allow clothes to be hung.

The clothes support member 110 may be provided to allow air to flow therein. Dust or foreign substances on clothes may be removed by the air supplied to the inside of the clothes support member 110. The clothes support member 110 may be provided with an air supply port 111 provided to supply air to clothes.

The second airflow outlet 120*b* of the clothes care compartment 11 may communicate with the clothes support member 110. The air discharged through the second airflow outlet 120*b* may be delivered to the clothes support member 110 through the air supply port 111 and then delivered to the inside of the clothes hung on the clothes support member 110 or the air discharged through the second airflow outlet 120*b* may be discharged to the outside of the air supply port 111 and then delivered to the outside of the clothes.

According to one embodiment of the present disclosure, the second airflow outlet 120*b* is arranged above the clothes support member 110, and the air discharged through the second airflow outlet 120*b* is supplied to the inside and the outside of the clothes, but is not limited thereto. For example, the second airflow outlet may be formed in various sizes at various positions to inject air into the clothes in various directions.

The clothes care compartment 11 may include a blower 122 configured to move the internal air of the clothes care compartment 11.

The clothes care compartment 11 may include a second duct 121, and the blower 122 may be installed in the second duct 121. The second duct 121 communicates with the clothes care compartment 11, and thus the second circulation flow path 120 configure to circulate between the clothes care compartment 11 and the second duct 121 may be formed. The blower 122 may be arranged on the second circulation flow path 120.

The second duct 121 may be formed behind the second airflow inlet 120*a* of the clothes care compartment 11. The second duct 121 may be provided in the upper portion of the rear surface of the clothes care compartment 11, and may include a filter member 60 therein. The second duct 121 may be coupled to the top cover 130 arranged above the clothes care compartment 11. The second duct 121 may be coupled to the top cover 130, and the blower 122 may be installed therein.

The blower 122 may include a blower motor 122*a* arranged in the upper rear portion of the clothes care compartment 11 and configured to generate a rotational force, and a second blower fan 122*b* configured to be rotated by the blower motor 122*a*. The second blower fan 122*b* may be accommodated by a fan case 122*c*.

The fan case 122*c* may be coupled to a duct bracket 124 provided on the upper surface 10*b* of the clothes care compartment 11. At least one duct hole 124*a* is formed in the duct bracket 124, and the second blower fan 122*b* is respectively coupled to the at least one duct hole 124*a* to move air of the second duct 121 to the second airflow outlet 120*b* of the second duct 121.

The second duct 121 may be connected to the second airflow inlet 120*a* and the second airflow outlet 120*b* of the clothes care compartment 11. One end of the second duct 121 may be connected to the second airflow inlet 120*a* of the clothes care compartment 11, and the other end of the second duct 121 may be connected to the second airflow outlet 120*b* of the clothes care compartment 11. A second duct inlet 121*a* of the second duct 121 may be connected to the second airflow inlet 120*a* and a second duct outlet 121*b* of the second duct 121 may be connected to the second airflow outlet 120*b*.

The second airflow outlet 120*b* of the clothes care compartment 11 may be formed in a position corresponding to the second duct outlet 121*b* of the second duct 121.

The second duct outlet 121*b* of the second duct 121 may be connected to the second airflow outlet 120*b* of the clothes care compartment 11, and the second airflow outlet 120*b* may communicate with the clothes support member 110. Accordingly, a portion of the air of the second duct 121 is delivered to the clothes support member 110.

The blower 122 arranged inside the second duct 121 is configured to suction the internal air of the clothes care compartment 11 through the second airflow inlet 120*a*, and configured to discharge the suctioned air to the second duct outlet 121*b* and the second airflow outlet 120*b*.

The filter member 60 is installed in the second airflow inlet 120*a* of the clothes care compartment 11. The second airflow inlet 120*a* is formed on the rear surface 10*f* of the clothes care compartment 11. A filter member mounting portion 11*c*, in which the filter member 60 is installed, is formed on the rear surface 10*f* of the clothes care compartment 11. The second airflow inlet 120*a* may be formed at a position corresponding to the filter member mounting portion 11*c*.

Upon flowing into the second duct 121, the internal air of the clothes care compartment 11 may be filtered by the filter member 60 of the second airflow inlet 120*a*. Dust and odor in the air introduced into the second duct 121 may be filtered out by the filter member 60. The air filtered by the filter member 60 may be discharged to the second duct outlet 121*b* and the clothes support member 110 by the blower 122.

The filter member 60 may include a dust collecting filter (not shown) configured to remove dust or a means configured to perform deodorization.

The clothes care compartment 11 starts the clothes care after the clothes are hung on the clothes support member 110 and the door 20 is closed. In this case, in the clothes care compartment 11, air may be circulated along the first circulation flow path 39 and the second circulation flow path 120.

Figure 5:
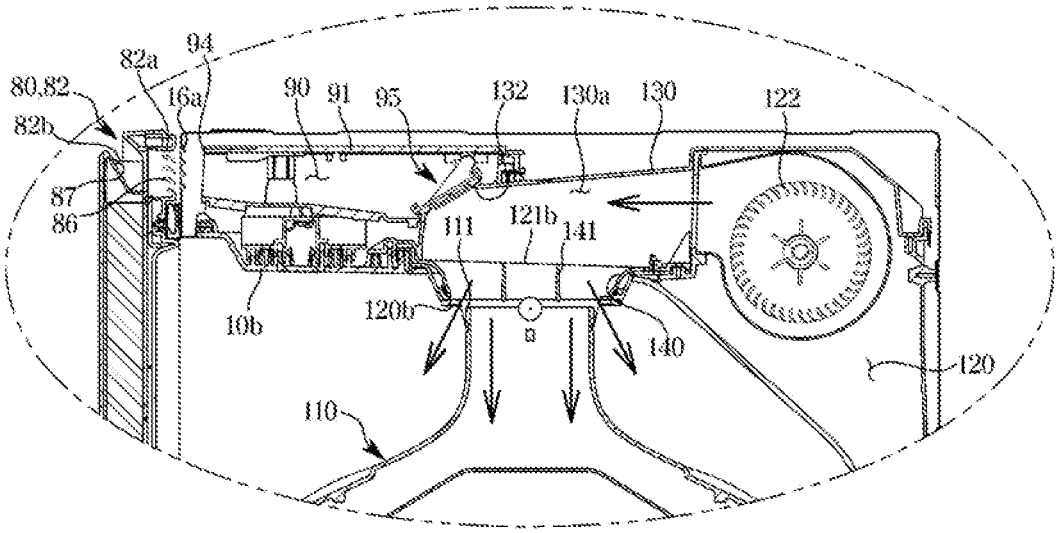
FIG. 5 is an enlarged view illustrating a portion of an upper side of the clothes care apparatus shown in FIG. 3.
Figure 6:
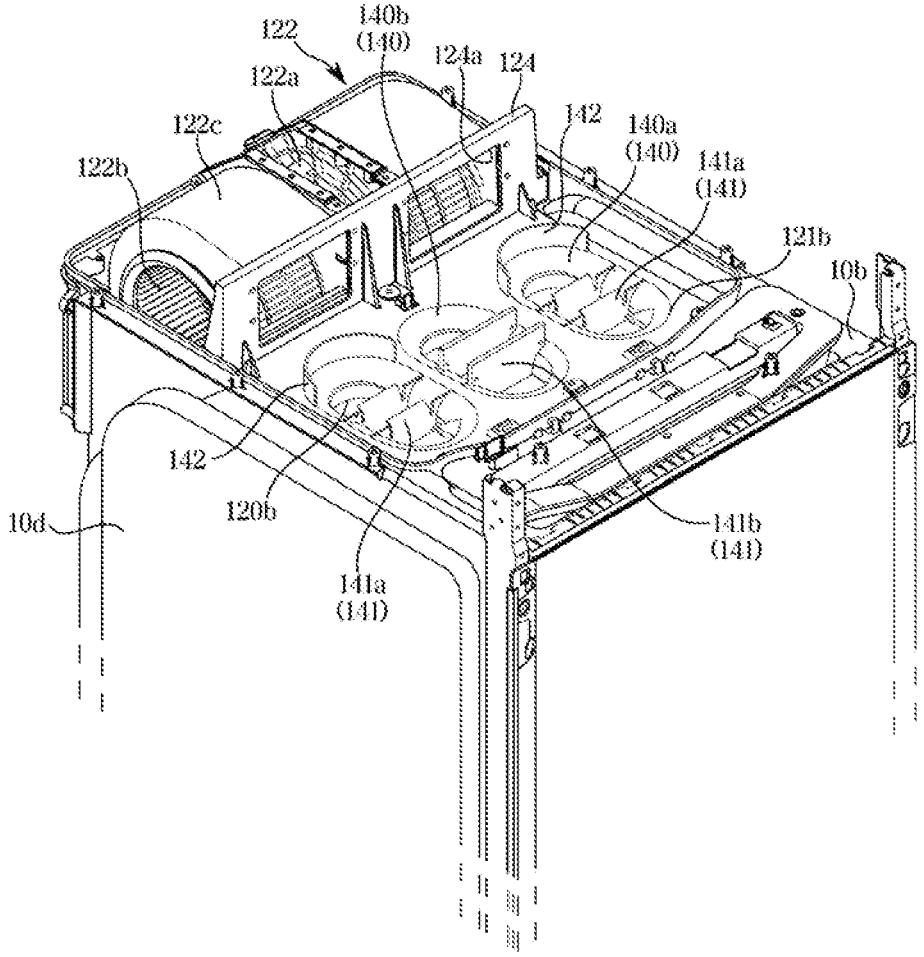
FIG. 6 is a view illustrating a guide flow path of a second circulation flow path formed inside a top cover of the clothes care apparatus shown in FIG. 1.
Figure 7:
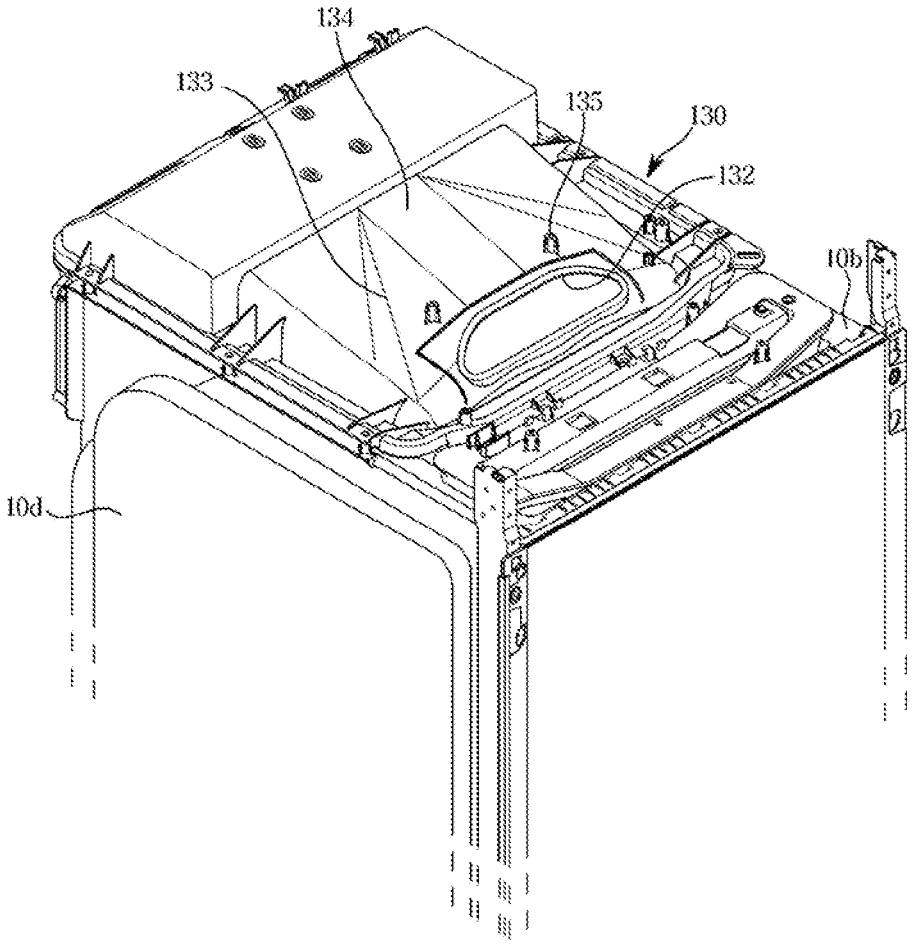
FIG. 7 is a view illustrating a state in which the top cover of the clothes care apparatus shown in FIG. 6 covers the guide flow path.

FIG. 5 is an enlarged view illustrating a portion of an upper side of the clothes care apparatus shown in FIG. 3. FIG. 6 is a view illustrating a guide flow path of a second circulation flow path formed inside a top cover of the clothes care apparatus shown in FIG. 1. FIG. 7 is a view illustrating a state in which the top cover of the clothes care apparatus shown in FIG. 6 covers the guide flow path.

Referring to FIGS. 5 to 7, the air passing through the blower 122 may be moved to a guide flow path 130*a* formed inside of the top cover 130. The guide flow path 130*a* is a part of the second circulation flow path 120. The guide flow path 130*a* may be formed by the top cover 130 and the upper surface 10*b* of the main body 10.

The clothes care apparatus 1 may include a nozzle 140 provided to guide air, which is introduced to the guide flow path 130*a*, to the clothes hung on the clothes support member 110. The nozzle 140 may be disposed on the upper surface 10*b* of the main body 10. One end of the nozzle 140 may be connected to the second duct outlet 121*b* and the other end thereof may be connected to the second airflow outlet 120*b*. Accordingly, it may be assumed that an opening formed at one end of the nozzle 140 is the second duct outlet 121*b*, and an opening formed at the other end of the nozzle 140 is the second airflow outlet 120*b*.

The nozzle 140 may guide the air in the guide flow path 130*a* to the clothes care compartment 11. Together with the top cover 130, the nozzle 140 may guide air, which is discharged from the blower 122, to the inside and outside of the clothes hung on the clothes support member 110.

Particularly, the second airflow outlet 120*b*, through which air guided by the nozzle 140 is discharged, may be formed to be larger than the air supply port 111 of the clothes support member 110. The second airflow outlet 120*b* may be provided to allow a portion of air, which is discharged through the second airflow outlet 120*b*, to be discharged to the inside of the clothes support member 110 through the air supply port 111, and configured to allow a remaining portion of the air to be discharged to the outside of the air supply port 111 and then discharged to the outside of the clothes support member 110. The second airflow outlet 120*b* may be formed to have a larger diameter than the air supply port 111. A portion of the air passing through the nozzle 140 may be discharged to an outer surface of the clothes support member 110 through a gap between the second airflow outlet 120*b* and the air supply port 111.

Due to this configuration, the clothes care apparatus 1 may perform the clothes care on not only the inside but also the outside of the clothes using the airflow.

The nozzle 140 may be formed to correspond to the number of clothes support members 110. FIGS. 4 and 6 illustrate that three nozzles 140 are provided as three clothes support members 110 are provided. However, the number of the clothes support member 110 and the nozzle 140 is not limited thereto, and two or less or four or more of the clothes support member 110 and the nozzle 140 may be provided as necessary.

In addition, FIGS. 4 and 6 illustrate that two second blower fans 122*b* are provided, but the number of the second blower fans 122*b* is not limited thereto, and thus one or three or more of the second blower fan may be provided.

Referring to FIGS. 5 and 6, the nozzle 140 may include two side nozzles 140*a* and a center nozzle 140*b*. The two side nozzles 140*a* may be respectively disposed at positions corresponding to the duct hole 124*a* through which the air discharged by the blower 122 passes. The center nozzle 140*b* may be disposed between the two side nozzles 140*a*.

Only one side nozzle 140*a* will be described below because the two side nozzles 140*a* include the same configuration.

The side nozzle 140*a* may include a first blade 141*a* and a guide rib 142.

The first blade 141*a* may be provided to guide the air, which is discharged from the blower 122 and passed through the duct hole 124*a*, to the second airflow outlet 120*b*. The first blade 141*a* may be disposed on a flow path formed in the side nozzle 140*a* between the second duct outlet 121*b* and the second airflow outlet 120*b*.

The first blade 141*a* may have a shape including a portion that is inclined downwardly from the rear side to the front side so as to guide the air, which is discharged in a front and rear direction by the blower 122, to a lower direction. The first blade 141*a* may include a curved portion formed to guide air, which is moved from the rear side to the front side, to the lower direction.

The guide rib 142 may be provided to distribute air, which is passed through the duct hole 124*a* by the blower 122, to the side nozzle 140*a* and the center nozzle 140*b*. The guide rib 142 may be provided to block a portion of the air that is discharged from the blower 122 and directed to the side nozzle 140*a*.

The guide rib 142 may be provided to change a moving direction of air, which is introduced into the guide flow path 130*a*, toward the center nozzle 140*b*. The moving direction of a portion of the air introduced into the guide flow path 130*a* may be changed to the upper side by the guide rib 142, and the air, which is moved to the upper side, may be guided to the center nozzle 140*b* along the top cover without being moved to the side nozzle 140*a*. The moving direction of other portion of the air introduced into the guide flow path 130*a* may be changed to directly face the center nozzle 140*b* by the guide rib 142.

The center nozzle 140*b* may include a second blade 141*b*. Unlike the first blade 141*a*, the second blade 141*b* may have a flat plate shape. Air introduced into the center nozzle 140*b* may be air that is guided directly to the center nozzle 140*b* by the guide rib 142, or air that is guided to the center nozzle 140*b* by the center nozzle 140*b* and the top cover 130.

The first blade 141*a* and the second blade 141*b* may be collectively referred to as a blade 141. The blades 141*a* and 141*b* may include a portion extending in a vertical direction, respectively. Air supplied from the rear side to the front side may be uniformly supplied along the front and rear direction of the lower clothes support member 110 by the blades 141*a* and 141*b*. The first blade 141*a* and/or the second blade 141*b* may be configured to be rotatable.

Due to this configuration, the clothes care apparatus 1 according to one embodiment of the present disclosure properly distributes the air, which is introduced into the guide flow path 130*a* by the two second blower fans 122*b*, to the three nozzles 140 so as to be supplied to the three clothes support members 110.

Referring to FIG. 7, the top cover 130 may include a vortex reducing portion 133 and a central portion 134.

The vortex reducing portion 133 may be disposed on opposite sides of the central portion 134. The vortex reducing portion 133 may be disposed to correspond to a position where the side nozzle 140*a* is disposed. Air introduced into the guide flow path 130*a* is introduced toward the front, but air discharged from the guide flow path 130*a* is discharged downward along the nozzle 140. Therefore, a vortex may be generated in a portion of the guide flow path 130*a* inside the top cover 130. Particularly, the vortex may be more likely to be generated on the opposite sides of the central portion 134 of the top cover 130 by the guide rib 142.

The vortex reducing portion 133 may be formed in such a way that the opposite sides, in which the vortex may be generated, of the central portion 134 is recessed with respect to the central portion 134. The vortex reducing portion 133 may be provided to incline downwardly from the rear side to the front side. The vortex reducing portion 133 may reduce a vortex that may be generated in the guide flow path 130*a*. The vortex reducing portion 133 may guide the air, in which the moving direction thereof is changed by the guide rib 142, to the central portion 134. The air, which is guided to the central portion 134, may be discharged to the clothes care compartment 11 through the center nozzle 140*b*.

Figure 8:
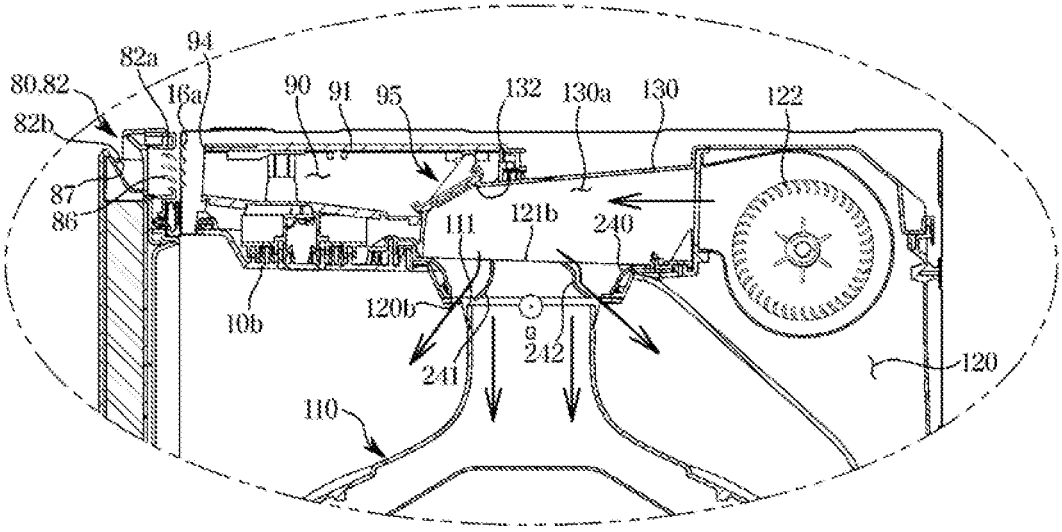
FIG. 8 is a view illustrating another embodiment of the blade shown in FIG. 5.

FIG. 8 is a view illustrating another embodiment of the blade shown in FIG. 5.

Hereinafter descriptions of parts that are similar to the above description will be omitted.

Referring to FIG. 8, a nozzle 240 may include blades 241 and 242 provided to allow air, which is discharged from the guide flow path 120 to the clothes care compartment 11, to be discharged widely to the outside of the clothes support member 110. The blades 241 and 242 may include a first blade 241 provided to guide air passing through the nozzle 240 to be discharged to the front side, and a second blade 242 provided to guide the air passing through the nozzle 240 to be discharged to the rear side.

The first blade 241 may guide air, which is discharged from the blower 122 and moved to a front end of the top cover 130, to be discharged through a gap between the second airflow outlet 120*b* and the air supply port 111. The first blade 241 may be disposed on a flow path formed in the nozzle 240. The first blade 241 may be formed to be inclined forward along the lower side.

The second blade 242 may guide air, which is discharged from the blower 122 and moved to the front end of the top cover 130 and then moved to the rear side again, to be discharged through the gap between the second airflow outlet 120*b* and the air supply port 111. The second blade 242 may be disposed on a flow path formed in the nozzle 240. The second blade 242 may be formed to include a portion that is inclined rearward along the lower side. The second blade 242 may include a portion extending in the vertical direction to immediately discharge a portion of the air, which is introduced into the guide flow path 130*a*, to a rear outer side of the clothes support member 110 before the air is moved to the front end.

Due to this configuration, the clothes care apparatus 1 according to one embodiment of the present disclosure may perform the clothes care on the outside of the clothes.

Figure 9:
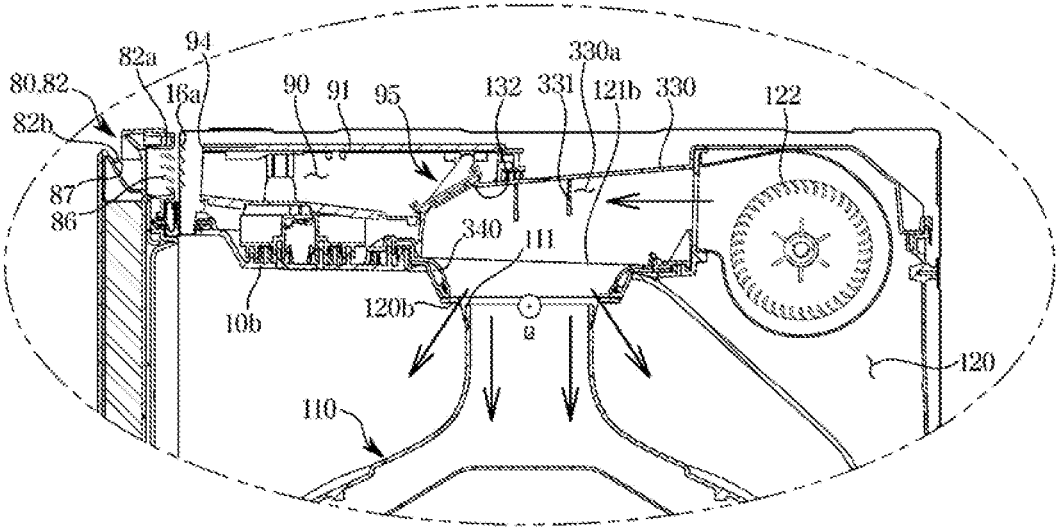
FIG. 9 is a view illustrating still another embodiment of the blade shown in FIG. 5.

FIG. 9 is a view illustrating still another embodiment of the blade shown in FIG. 5.

Hereinafter descriptions of parts that are similar to the above description will be omitted.

Referring to FIG. 9, a blade 331 may be provided on a top cover 330, and a blade may be omitted in a nozzle 340.

The blade 331 may extend downward from an upper inner surface of the top cover 330. The blade 331 may be integrally formed with the top cover 330. The blade 331 may be formed separately from the top cover 330 and then mounted on the top cover 330.

The blade 331 may change a moving direction of a portion of air, which is introduced to a guide flow path 330*a* by the blower 122, to the lower side. Accordingly, air supplied to the guide flow path 330*a* to the front side may be uniformly distributed and supplied along the front and rear directions of the lower clothes support member 110.

Figure 10:
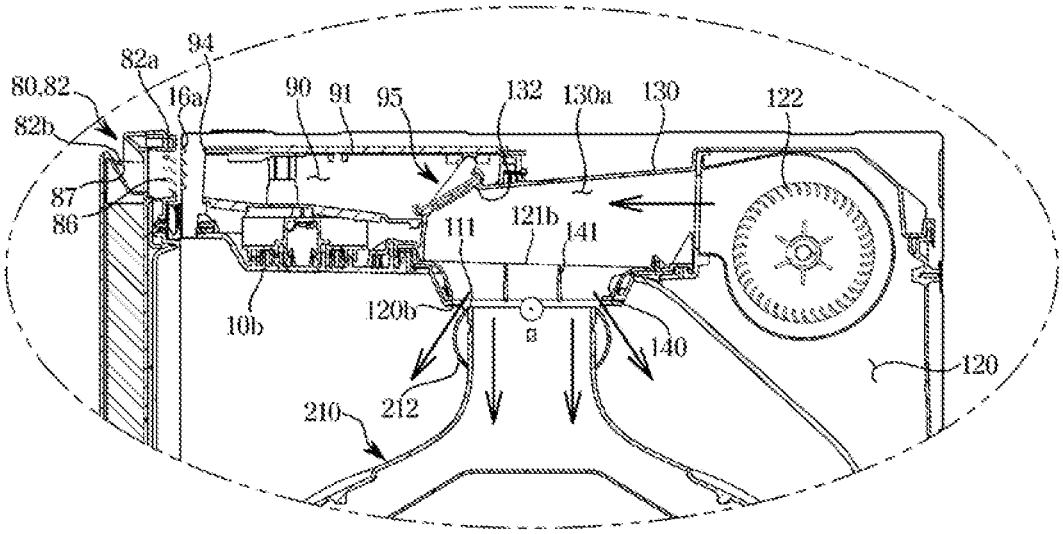
FIG. 10 is a view illustrating another embodiment of a clothes support member shown in FIG. 5.

FIG. 10 is a view illustrating another embodiment of a clothes support member shown in FIG. 5.

Hereinafter descriptions of parts that are similar to the above description will be omitted.

Referring to FIG. 10, a clothes support member 210 may include the air supply port 111 provided to communicate with the second airflow outlet 120*b* to allow a portion of air, which is discharged through the second airflow outlet 120*b*, to be introduced into an inside of the clothes support member 210, and a guide protrusion 212 provided to guide a remaining portion of the air, which is discharged through the second airflow outlet 120*b*, to be discharged to the outside of the clothes support member 210.

The guide protrusion 212 may be disposed on an upper end of the clothes support member 210. The guide protrusion 212 may extend along a circumference of the upper end of the clothes support member 210. The guide protrusion 212 may be formed to protrude from an upper outer surface where the air supply port 111 is formed. The guide protrusion 212 may guide air, which is discharged through a gap between the second airflow outlet 120*b* and the air supply port 111, to be widely discharged to the outside of the clothes support member 110. The guide protrusion 212 may guide a portion of the air, which is discharged through the second air flow outlet 120*b*, to be discharged toward a shoulder portion of the clothes hung on the clothes support member 110. Further, the guide protrusion 212 may also include a curved portion provided to guide other portion of the air, which is discharged through the second airflow outlet 120*b*, to a collar portion of the clothes. That is, a portion of the air, which is discharged through the second airflow outlet 120*b*, may be discharged to the outside of the clothes support member 110 along the upper surface of the guide protrusion 212, and the other portion of the air may be discharged along the outer surface of the clothes support member 110 along a lower surface of the guide protrusion 212.

Due to this configuration, the clothes care apparatus 1 according to one embodiment of the present disclosure may perform the clothes care on the outside of the clothes.

Figure 11:
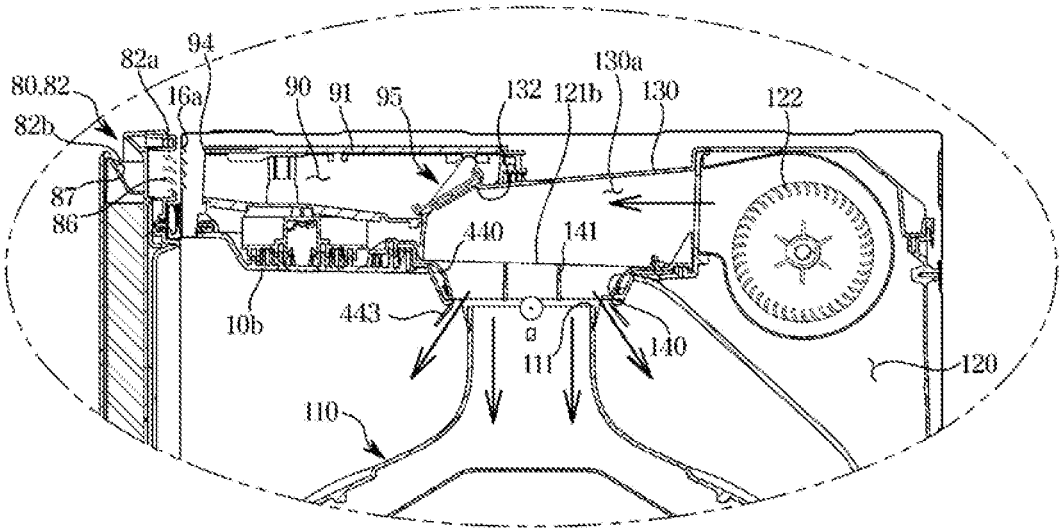
FIG. 11 is a view illustrating another embodiment of the nozzle shown in FIG. 5.

FIG. 11 is a view illustrating another embodiment of the nozzle shown in FIG. 5.

Hereinafter descriptions of parts that are similar to the above description will be omitted.

Referring to FIG. 11, a nozzle 440 may include a discharge rib 443 provided to guide a portion of air, which is discharged through the nozzle 440, to be discharged to the outside of the clothes support member 110. The discharge rib 443 may extend from a rim of a lower end of the nozzle 440 toward the outside of the nozzle 440.

A portion of the air, which is discharged through the nozzle 440, may be guided to the outside of the clothes support member 110 along the discharge rib 443 by Coanda effect. The discharge rib 443 may perform a function similar to the guide protrusion 212 shown in FIG. 10.

While the present disclosure has been particularly described with reference to exemplary embodiments, it should be understood by those of skilled in the art that various changes in form and details may be made without departing from the spirit and scope of the present disclosure.

The invention claimed is:

1. A clothes care apparatus comprising:

a main body comprising a clothes care compartment;

a clothes support member disposed in the clothes care compartment and comprising an air supply port provided to allow air to flow therein;

a blower configured to form an airflow to be supplied to the clothes support member; and a nozzle provided to guide the airflow formed by the blower to the clothes support member, and comprising an airflow outlet disposed to face the air supply port, the airflow outlet provided to supply an airflow to an inside and an outside of the clothes support member, wherein a size of the airflow outlet is greater than a size of the air supply port.

2. The clothes care apparatus of claim 1, wherein the main body comprises an airflow inlet formed on a rear surface of the main body, wherein the blower is configured to suction air, which is discharged to the clothes support member though the airflow outlet, through the airflow inlet and configured to discharge the suctioned air to the airflow outlet.

3. The clothes care apparatus of claim 1, wherein the nozzle comprises a blade provided to guide and distribute the airflow, which is supplied from the blower, to the clothes support member.

4. The clothes care apparatus of claim 3, wherein the blade comprises a curved portion provided to change a direction of the airflow supplied from the blower.

5. The clothes care apparatus of claim 3, wherein the blade is formed to face the outside of the clothes support member along a direction in which air moves.

6. The clothes care apparatus of claim 1, further comprising:

a top cover provided to connect the blower to the nozzle and provided to form a guide flow path, wherein the top cover comprises a central portion and a vortex reducing portion formed to be recessed on opposite sides of the central portion.

7. The clothes care apparatus of claim 6, wherein the vortex reducing portion is provided to guide a portion of the air, which is discharged from the blower, to the central portion.

8. The clothes care apparatus of claim 6, wherein the top cover comprises a blade provided to guide the air, which is discharged from the blower, to the nozzle.

9. The clothes care apparatus of claim 6, wherein the vortex reducing portion is formed to be inclined downwardly along a direction in which the air, which is discharged from the blower, moves.

10. The clothes care apparatus of claim 1, wherein the blower comprises two blower fans, and the nozzle comprises a center nozzle, and two side nozzles arranged on opposite sides of the center nozzle, wherein each side nozzle comprises a guide rib arranged on one side thereof facing the blower fan.

11. The clothes care apparatus of claim 10, wherein the guide rib is provided to change a moving direction of a portion of the airflow supplied from the blower.

12. The clothes care apparatus of claim 10, wherein the guide rib is provided to guide a portion of the air, which is discharged from the blower, toward the center nozzle.

13. The clothes care apparatus of claim 1, wherein the clothes support member comprises a guide protrusion provided to guide a portion of the air, which is discharged from the airflow outlet, toward the outside of the clothes support member.

14. The clothes care apparatus of claim 1, wherein the nozzle comprises a discharge rib provided to guide a portion of the air, which is discharged from the airflow outlet, toward the outside of the clothes support member.

15. The clothes care apparatus of claim 1, wherein a direction of the airflow, which is supplied to the clothes support member through the nozzle, is different from a direction of the airflow formed by the blower.

* * * * *